United States Patent [19]

Bernhardt

[11] Patent Number: 4,555,043

[45] Date of Patent: Nov. 26, 1985

[54] ANTI-SPILL RECLOSEABLE CONTAINER

[76] Inventor: Daniel Bernhardt, P.O. Box 681, Rutland, Vt. 05701

[21] Appl. No.: 676,737

[22] Filed: Nov. 29, 1984

[51] Int. Cl.[4] ..... B65D 43/02

[52] U.S. Cl. ..... 220/306; 220/257

[58] Field of Search ..... 220/306, 257, 359; 229/43; 206/439

[56] References Cited

U.S. PATENT DOCUMENTS

| | | | |
|---|---|---|---|
| 4,040,561 | 8/1977 | Philippon | 220/257 |
| 4,124,141 | 11/1978 | Armentrout et al. | 220/306 |
| 4,466,552 | 8/1984 | Butterworth et al. | 220/306 |

*Primary Examiner*—George T. Hall

*Attorney, Agent, or Firm*—Mark T. Basseches; Paula T. Basseches

[57] ABSTRACT

A spill-resistant container of deformable polymeric material is disclosed. The container includes a lid mountable in the container. A characterizing feature of the device resides in the provision of portions of the container surrounding the lid being inwardly deflectible into overlapping relation of the lid responsive to lateral, inwardly directed forces applied thereagainst. The invention includes a method of forming the container which involves applying a heat-sealable, heat-shrinkable membrane to portions of the container outwardly of the lid and thereafter causing the membrane to shrink, thus to deflect portions of the container into upwardly lapping relation of portions of the lid.

10 Claims, 6 Drawing Figures

FIG. 1
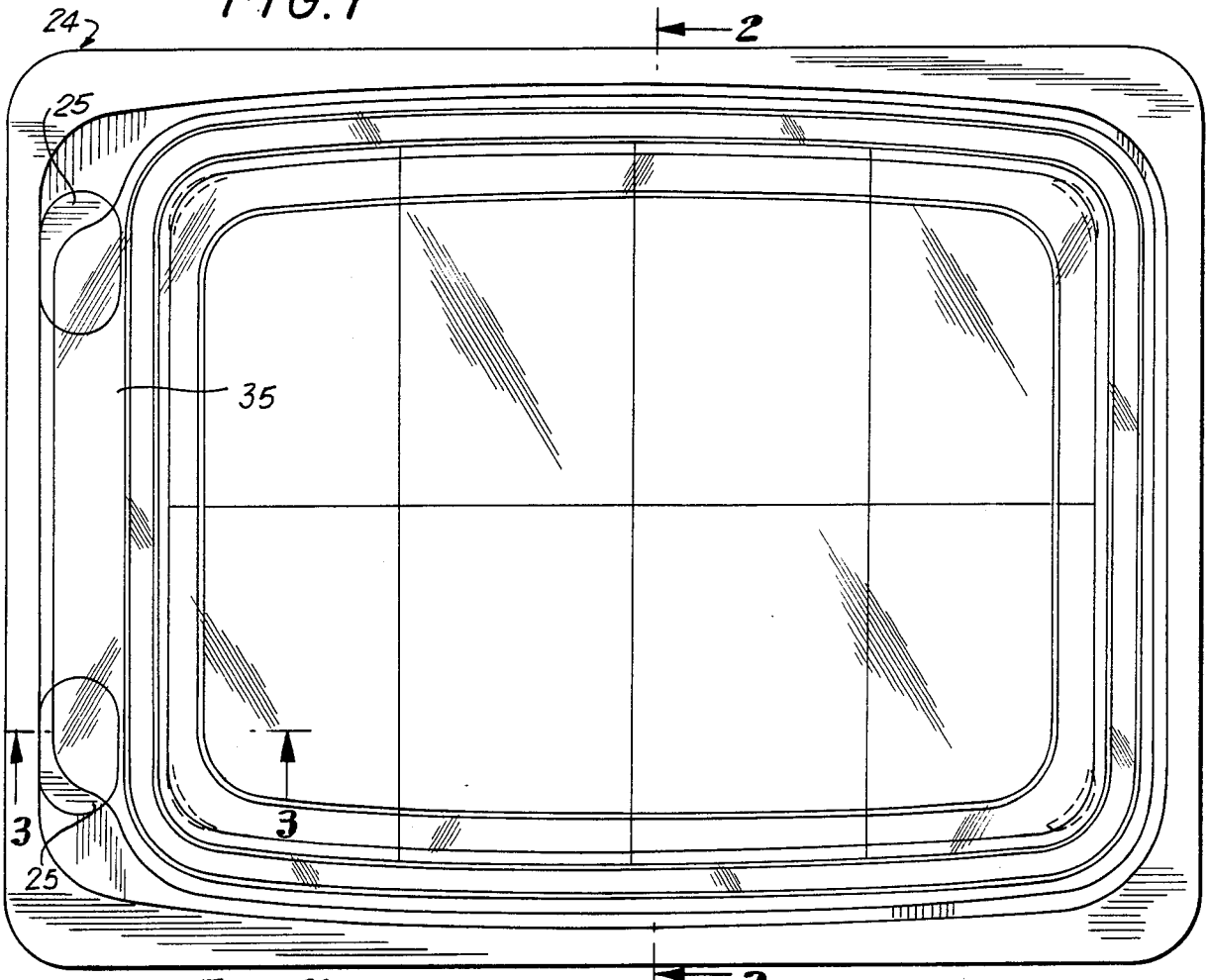
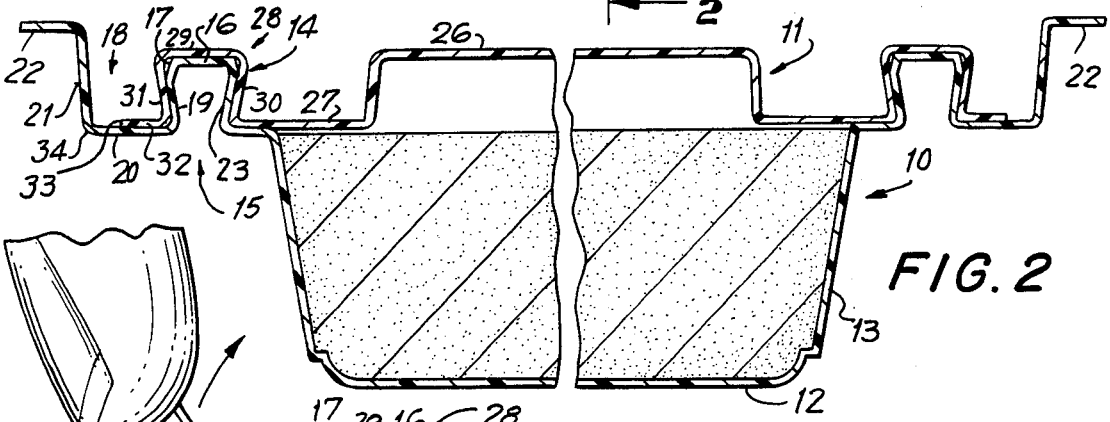
FIG. 2
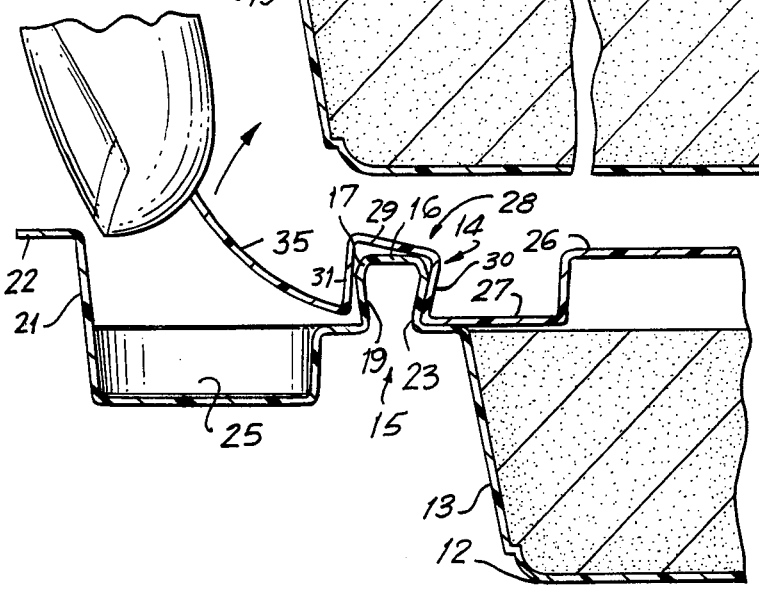
FIG. 3

FIG. 4
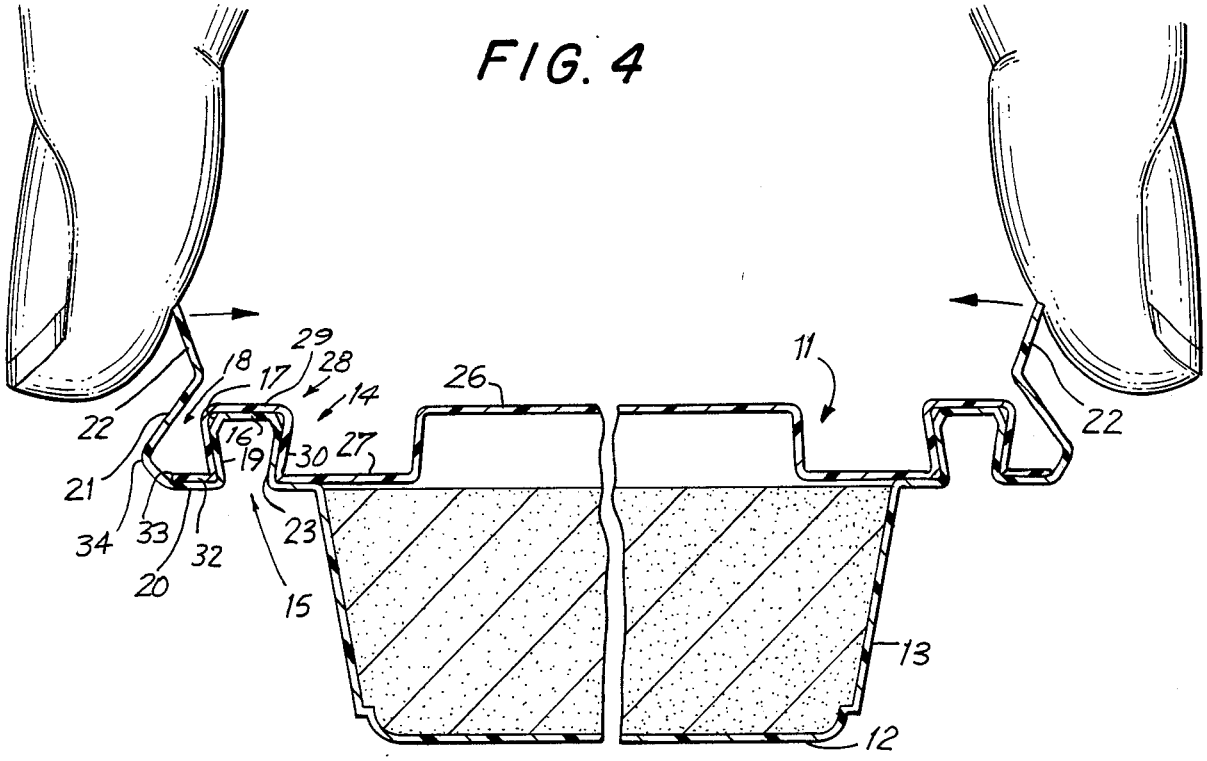
FIG. 5
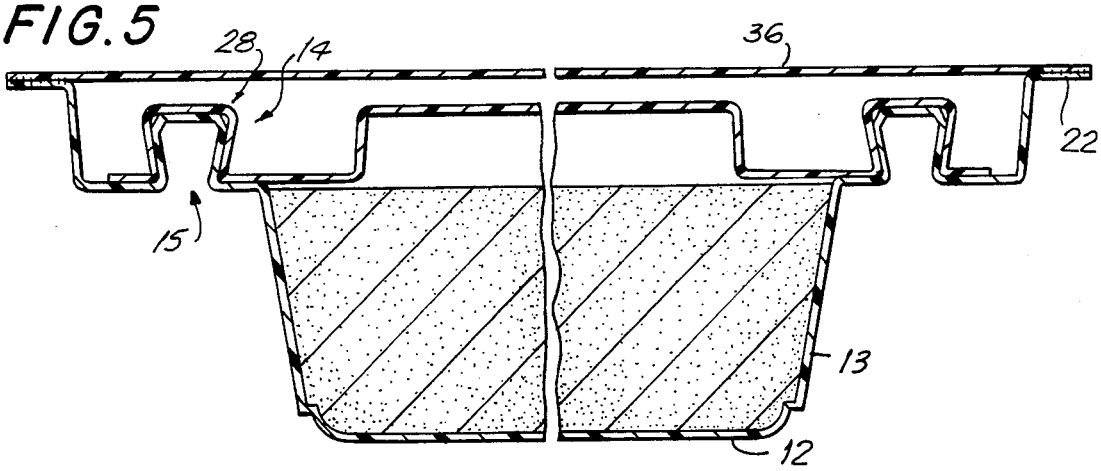
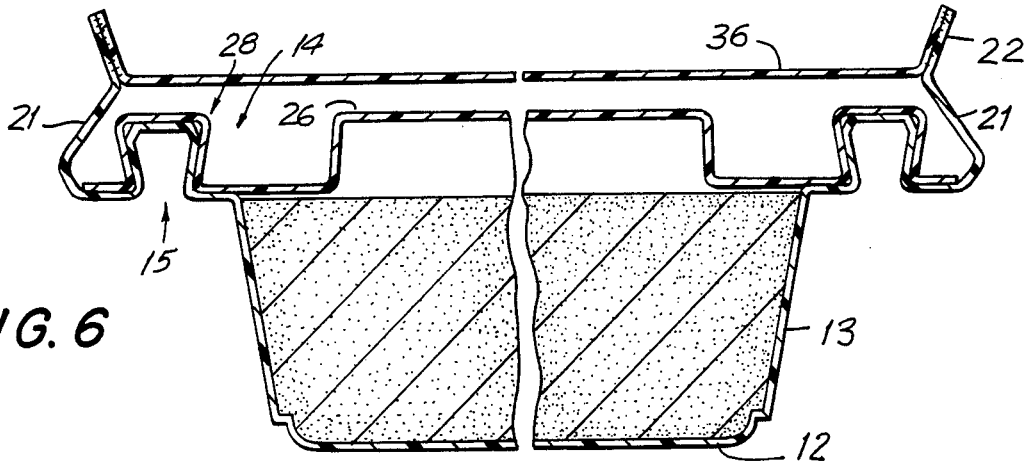
FIG. 6

ANTI-SPILL RECLOSEABLE CONTAINER

BACKGROUND OF THE INVENTION

1. Field of the Invention

The present invention is directed to improvements in containers for food portions and the like and relates more particularly to a recloseable, spill-resistant container.

2. The Prior Art

Food portions and the like are frequently supplied in recloseable containers comprised cf polymeric materials such as acetates, polyesters, polystyrenes, polymeric foams, etc. Such containers must be inexpensive since for the most part they are disposable. Containers are accordingly fabricated of relatively thin stock and are thus readily deformable. While numerous container designs exist, they are conventionally similar in that the containers include a lid or cover which is snap-fittedly connected to a complemental conformation on the container.

By way of example, the container may include a U-shaped configuration surrounding the mouth, and the lid may include a complemental U configuration which snaps into the container configuration.

Containers may also include a tamper-resistant membrane heat-sealingly bonded to a flange formed on the container and surrounding the lid. Such membrane provides reasonable assurance that the lid will remain in position. However, once the membrane is removed to provide access to the contents, the sole reclosing function is provided by the interfit of lid and container.

In such conventional designs, by reason of the deformability of the container any lateral or crushing forces exerted on the container, and partcularly on the lid portion thereof, will readily dislodge the lid, with resultant reduction of container volume and spilling of the contents.

A typical circumstance in which such accidental spillage may occur is when a container of the type described is lifted by gripping the container at its top portion, forcing the side walls inwardly, or when a container is packed in a bag along with other articles and the bag is lifted.

Representative examples of a packaging device of the type described may be found in U.S. Pat. No. 4,346,883 of Aug. 31, 1982, owned by the applicant herein, and the references cited therein.

SUMMARY OF THE INVENTION

The present invention may be summarized as directed to a recloseable container characterized in that lateral or crushing forces applied to the container, and especially adjacent the cover area thereof, function to lock the cover in its sealed position, thereby preventing the accidental dislodgement of the cover unless, of course, the forces applied are so gross as to crush the container.

More particularly, the invention is directed to a recloseable container made of readily deformed and resilient polymeric material or the like, and a snap-fittedly connected cover therefor. The container includes an outwardly projecting rim or closure configuration which receives, in snap-fitted fashion, a lid or cover member. The closure configuration includes a hinge or flexure area and locking components lying circumferentially outwardly of the hinge connection area. When inward forces are exerted against the circumferential portion of the container elements of the locking components of the container are deflected inwardly into overlapping relation of the lid, with the result that the lid is precluded from shifting upwardly.

The container of the invention may be employed, in addition, with a tamper-proof seal membrane bonded to a flange portion thereof. Optionally, the membrane may be formed of heat-shrink material. After attachment, the membrane may be subjected to a heat-shrinking step which functions to contract or foreshorten the membrane and thus deflect portions of the locking components of the container inwardly into the overlapping position of the lid.

It is accordingly an object of the invention to provide an improved resealable container characterized in that lateral forces exerted against the container, and particularly at the mouth portion thereof, will not result in the dislodgement of the lid or cover.

A further object of the invention is the provision of a container of the type described which may optionally be used with a tamper-resistant seal membrane.

Still a further object of the invention is the provision of a container of the type described wherein the membrane, after application, is effective, by virtue of heat-shrinking thereof, to deflect portions of the locking components of the container into the lid-locking position thereof.

Still a further object of the invention is the provision of a method of closing a container of the type described wherein the lid and lid-retaining components of the container are automatically shifted into the lid-locking position thereof.

To attain these objects and such further objects as may appear herein or be hereinafter pointed out, reference is made to the accompanying drawings, forming a part hereof, in which:

FIG. 1 is a top plan view of a container in accordance with the invention;

FIG. 2 is a vertical section taken on the line 2—2 of FIG. 1;

FIG. 3 is a fragmentary vertical section taken on the line 3—3 of FIG. 1;

FIG. 4 is a vertical sectional view similar to the view of FIG. 2 showing the position occupied by the parts when inward forces are exerted against the upper portions of the container;

FIG. 5 is a view similar to FIG. 2 showing the container with a tamper-resistant membrane applied;

FIG. 6 is a view of the container of FIG. 5 after shrink treatment of the membrane.

Referring now to the drawings, there is shown in the figures a container 10 and a lid 11 adapted to be frictionally or snap-fittedly connected to the container. The container and the lid are preferably formed of polymeric materials, such as acetates, polyesters, polystyrenes, polymeric foams or the like.

As is conventional, the container and lid are formed of relatively thin gauge materials for reasons of economy, and are thus readily deformable.

The container 10 includes a bottom 12 and generally vertically directed side wall portions 13. It will be recognized that the side wall portions 13 may be in any desired configuration, i.e. they may be formed in a circular configuration if circular packages are desired, the illustrated embodiment being in the general form of a rectangle having elongated side walls which are slightly arcuate and straight end walls.

The container includes a mouth portion 14 defined by the upper ends of the side wall portion 13 and a rim defining a closure configuration 15 projecting laterally outwardly from the mouth portion 14 of the side walls. The closure configuration 15 includes a laterally directed ledge portion 16, to the outer extremity 17 of which is connected a trough configuration 18 including a depending inner leg 19, a branch portion 20 and an outer leg 21. Preferably a bumper flange 22 extends outwardly from the upper extremity of the outer leg 21 of the trough conformation. As will be understood from the ensuing description the locking function is performed by portions of the branch 20 and outer leg 21 which form the locking components.

As will be apparent from an inspection of the drawings, the uppermost portion 23 of the side walls 13 adjacent the mouth 14 may be inwardly and upwardly inclined so that the portions 19, 16 and 23 together define a dovetail configuration enabling a snap-fitted connection with a complementally formed portion of the lid 11, as will be evident hereinafter. Other forms of lid-receiving configurations may obviously be employed.

Optionally, for facility of opening, the branch portion 20 at one end 24 of the container may be enlarged laterally and include a pair of depressions 25, 25 (see FIG. 3) which, as will be pointed out hereinafter, facilitate a lifting of an end of the lid from its mounted position.

The lid 11 optionally may include a central raised portion 26 and a surrounding peripheral ledge 27 which leads to a perimetal rim configuration 28. Alternatively, the entirety of the central portion of the rim may be of a flatwise configuration substantially at the height of the ledge 27.

The rim configuration 28 is preferably in the form of an inverted U having a central branch 29, an inner leg 30, the lowermost end of which is connected to the uppermost edge of ledge 27, and an outer leg 31. The legs 30 and 31 preferably converge in a downward direction so as to define a dovetail configuration adapted to be snap-fittedly connected over the complemental configuration defined by the components 16, 19 and 23 of the container.

From the lowermost end of the leg 31 there is outwardly extended a stiffener or locking flange 32, the distal or free end 33 of which lies in proximate but spaced relation to the junction 34 of upstanding leg 21 and branch 20 of the closure configuration of the container.

As seen in the drawings, the stiffener flange 32, in the applied condition of the cover, abuts or engages the branch portion 20 of the trough configuration 18, providing a rigidified structure in the area of the double thickness of the flange and branch. The junction area 34 of leg 21 and branch 20 of the trough 18 outwardly of flange 32 thus defines a hinge or flexure area about which the leg 21 and bumper flange 20 may bodily pivot in an inward direction. Optionally the junction 34 or portions of branch 20 outwardly of flange 32 may be weakened or formed with a flexure joint to facilitate the hinging or flexing action.

The cover 11 may include a lifting flap 35 which partially overlies depressions 25 to facilitate removal of the cover (FIG. 3).

The manner in which the device functions may best be appreciated from a comparison of FIGS. 2 and 4.

In FIG. 2 the cover is shown in unstressed snap-fitted connection with the container. By virtue of the dovetail interconnection of the cover and container (a configuration which is known per se), the cover will be retained in its seated position over the container.

In FIG. 4 there is disclosed the position assumed by the parts when an inward force is applied to opposed portions of the bumper flange 22. As will be apparent from FIG. 4, the net effect of application of such forces is a flexure of the branch 20 in the area outwardly of stiffener flange 32, with the result that the leg 21 is disposed over the flange 32, further inward deflection of the bumper flange functioning to superpose the leg 21 over the branch 29 of the cover. With the parts thus positioned it will be readily appreciated that the leg 21 will function positively to preclude an unseating of the cover member from the container since the leg is in blocking position of upward movement of the cover.

While the compressive forces have been illustrated as having been supplied by manual pressure exerted against opposed areas of the bumper flange, it will be readily recognized that the disclosed construction provides a safeguard against unseating of the cover against any force exerted on opposed areas of the bumper flange. For instance, if a container of the type described is placed in a bag between objects disposed to opposite sides of the container and the bag is lifted, the opposed objects may converge and press against opposite portions of the bumper flange, with the resultant deformation of the container to the position shown in FIG. 4, with the attendant result that, notwithstanding such laterally applied forces, the container top will not pop free. In contrast, a conventional container, when subjected to such lateral forces, will deform in such way as to expel the container top in an upward direction, with resultant spilling of the contents.

In FIG. 5 the container of FIG. 2 is illustrated in conjunction with a membrane 36 which is heat-sealingly connected to the upper surfaces of the bumper flange 22. In view of the pliability of the membrane 36, the same does not interfere with functioning of the container in the manner hereinabove described to prevent inadvertent dislodgement of the cap.

In FIG. 6 there is disclosed an embodiment as shown in FIG. 5. The embodiment of FIG. 6 differs from that of FIG. 5 in that the membrane 36 thereof has been formed of a heat-shrinkable material which, after application of the heat seal, has been subjected to a shrinking step. As will be observed, the result of the heat-shrinking of the membrane has been to deflect the legs 21 of the closure configuration into overlying relation of portions of the cover whereby a positive guard against upward deflection of the cover is provided.

From the foregoing it will be perceived that there is disclosed in accordance with the present invention a unique container and cover construction characterized in that inward compressive forces exerted against the container adjacent the upper portions thereof function to deflect elements of the container into overlapping positions of elements of the cover, with the result that the cover cannot be dislodged in an upward direction notwithstanding significant deformation of the container.

It will further be appreciated that there is defined a method of applying a heat sealable membrane over a container which results, upon shrinkage of the heat-sealing member, in deforming portions of the container into blocking relationship of portions of the cover, thus acting as a secondary guard against dislodgement of the cover.

It will be obvious to those skilled in the art and familiarized with the foregoing disclosure that numerous variations in details of construction may be made in the described embodiments without departing from the spirit of the invention. Accordingly, the same is to be broadly construed within the scope of the appended claims.

Having thus described the invention and illustrated its use, what is claimed as new and is desired to be secured by Letters Patent is:

1. A resealable, spill-resistant container of deformable polymeric material comprising a bottom, upwardly directed side walls extending therefrom, the uppermost ends of said walls defining an open mouth, a rim configuration extending outwardly from said side walls and surrounding said mouth, a perimetrical lid receiving portion formed on said rim configuration outwardly adjacent said mouth, a lid member including a perimetal seal portion sealingly received in said receiving portion and a lid lock assembly integrally formed on said rim configuration, said lock assembly including a branch portion extending laterally outwardly beyond said seal portion at a level below said seal portion, a leg member extending upwardly from said branch portion, the uppermost end of said leg member being disposed at a height above said seal portion, the area between said leg member and seal portion being flexible, said leg member being positioned to be shifted into upwardly lapping position of said seal portion responsive to pressure exerted thereagainst in the direction of the interior of said container.

2. A container in accordance with claim 1 and including a bumper flange extending outwardly from the uppermost end of said leg.

3. A container in accordance with claim 2 wherein said seal portion of said lid member includes an outwardly directed stiffener flange disposed in abutting relation to said branch, said flange terminating in spaced relation to the junction of said branch and leg member, thereby to limit flexure of said branch to the area outwardly of said stiffener flange.

4. A container in accordance with claim 2 and including a membrane heat-sealingly connected to the upper surface of said bumper flange along a perimetrical seal line surrounding said lid.

5. A container in accordance with claim 4 wherein said membrane is formed of heat-shrinkable material, and said membrane is in stressed condition, whereby said leg member is inwardly deflected into said upwardly lapping position.

6. A container in accordance with claim 1 wherein said seal portion of said lid member includes an outwardly directed stiffener flange disposed in abutting relation to said branch, said flange terminating in spaced relation to the junction of said branch and leg member, thereby to limit flexure of said branch to the area outwardly of said stiffener flange.

7. An anti-spill recloseable container assembly formed of polymeric material or the like comprising a container having a bottom, side wall portions extending upwardly from said bottom, the uppermost ends of said side wall portions defining an open mouth, a closure configuration outwardly surrounding said mouth, said configuration including a generally U-shaped trough including generally vertically directed inner and outer legs and a branch extending between said legs, said outer leg projecting upwardly beyond said inner leg, a cover member in closing relation of said mouth, said cover member including a rim portion in snap-fitted engagement with portions of said closure configuration, and a generally horizontally directed stiffener flange disposed in said trough in abutting relation to said branch, the outermost extremity of said stiffener flange lying in proximate relation to said hinge connection, the area of said branch outwardly of said flange being flexible, whereby inward forces applied against said leg deform said portions of said branch between said stiffener flange and said leg thereby to deflect said leg into overlapping position of said rim portion.

8. A container in accordance with claim 7 and including a bumper flange projecting outwardly from said outer leg, said bumper flange being disposed at a level above said rim portion.

9. A spill-resistant container of deformable polymeric material comprising a bottom, upwardly directed side walls, the uppermost ends of said side walls defining an open mouth, a rim configuration surrounding said mouth, a perimetrical lid receiver portion on said rim configuration, a lid having a perimetal seal portion retained in said receiver portion, an upstanding leg formed on said rim configuration outwardly adjacent said seal portion of said lid, said leg being disposed at a height above said seal portion, a flange extending outwardly from the uppermost end of said leg, a heat-shrinkable, heat-sealable membrane bonded to said flange along a perimetric seal line, said membrane being in stressed condition thereby to deflect said leg members inwardly into overlapping position of said seal portion.

10. The method of manufacturing a spill-resistant container of deformable polymeric material which comprises the steps of providing an integral container having a bottom, side walls, and a rim configuration extending outwardly from the upper ends of said side walls, said rim configuration including a lid receiver seat, stop portions extending laterally outwardly of said seat, said stop portions being at a level above said seat, and a surrounding flange extending laterally outwardly from the upper end of said stop portions, providing a lid having a peripheral seal portion, inserting said seal portion of said lid into said receiver seat, providing a heat-sealable, heat-shrinkable membrane sized to register with said flange, disposing said membrane in registry with said flange, forming a heat-seal connection between said membrane and flange surrounding said lid, and thereafter applying heat-shrinking influences to said membrane to cause the same to contract and shift said leg portions inwardly into overlapping relation of said lid.

* * * * *